US007916094B2

(12) United States Patent
Neto et al.

(10) Patent No.: US 7,916,094 B2
(45) Date of Patent: Mar. 29, 2011

(54) DOUBLE STRUCTURE BROADBAND LEAKY WAVE ANTENNA

(75) Inventors: Andrea Neto, Voorburg (NL); Raymond van Dijk, Amsterdam (NL); Filippo Marliani, Oegstgeest (NL)

(73) Assignee: Nederlandse Organisatie Voor Toegepast-natuurwetenschappelijk Onderzoek TNO, Delft (NL)

( * ) Notice: Subject to any disclaimer, the term of this patent is extended or adjusted under 35 U.S.C. 154(b) by 637 days.

(21) Appl. No.: 11/572,480

(22) PCT Filed: Jul. 15, 2005

(86) PCT No.: PCT/NL2005/000514

§ 371 (c)(1),
(2), (4) Date: Apr. 30, 2008

(87) PCT Pub. No.: WO2006/009433

PCT Pub. Date: Jan. 26, 2006

(65) Prior Publication Data

US 2008/0266197 A1 Oct. 30, 2008

(30) Foreign Application Priority Data

Jul. 23, 2004 (EP) ..... 04077131

(51) Int. Cl.
*H01Q 13/00* (2006.01)

(52) U.S. Cl. ..... 343/785; 343/770

(58) Field of Classification Search ..... 343/702, 343/767, 770, 785, 911 R
See application file for complete search history.

(56) References Cited

U.S. PATENT DOCUMENTS

| | | | | |
|---|---|---|---|---|
| 5,231,414 | A * | 7/1993 | Ladds | 343/895 |
| 6,597,323 | B2 * | 7/2003 | Teshirogi et al. | 343/786 |
| 7,006,043 | B1 * | 2/2006 | Nalbandian | 343/700 MS |
| 7,586,464 | B2 * | 9/2009 | Neto et al. | 343/911 R |

* cited by examiner

*Primary Examiner* — Tan Ho
(74) *Attorney, Agent, or Firm* — Leydig, Voit & Mayer, Ltd

(57) ABSTRACT

A leaky wave antenna contains a first and a second leaky wave antenna structure back to back against each other. Each antenna structure comprises a dielectric body and an elongated wave carrying structure, such as a slot in a conductive ground plane. In each leaky wave antenna structure the body and wave carrying structure are mutually arranged to radiate a leaky wave from the wave carrying structure through the dielectric body, the leaky wave radiating at a respective angle to the wave carrying structure. The dielectric bodies of the first and second wave antenna structure adjoin each other in a common plane that is at said respective angles to the wave carrying structures of the first and second wave antenna structure respectively, so that the ground planes are at an angle with respect to each other. The respective wave carrying structures run over into each other at said common plane, the antenna comprising a feed arranged to excite waves in both the respective wave carrying structures together. In this way bandwidth limitations due to the feed structure are reduced.

11 Claims, 2 Drawing Sheets

DOUBLE STRUCTURE BROADBAND LEAKY WAVE ANTENNA

FIELD OF THE INVENTION

The invention relates to a broadband leaky wave antenna.

BACKGROUND

In the IEEE Transactions on Antennas and Propagation Vol. 51 No. 7 July 2003 pages 1572-1581 an article has been published titled "Green's function for an Infinite Slot Printed Between Two Homogeneous Dielectrics, Part I: Magnetic Currents", by Andrea Neto and Stefano Maci. A second part of this article has been published in the IEEE Transactions on Antennas and Propagation Vol. 52 No. 3 March 2004, on pages 666-676. The first article mentions the possibility of building a sub-millimeter wave receiver that is integrated with a dielectric lens and that contains a slot printed on an infinite slab.

The articles describe the properties of electromagnetic waves that travel along a structure with a conductive ground plane that contains a narrow elongated non-conductive slot, when two dielectric media with different dielectric constants $\in_1 \in_2$ are present on opposite sides of the ground plane. It is shown that in this configuration a wave travels along the length of the slot, and that part of the wave energy is radiated under a predetermined angle relative to the ground plane.

The articles refer to the possibility of using this phenomenon to realize a leaky wave antenna, but give no details about the structure of such an antenna. In a leaky wave transmission antenna an electromagnetic wave travels along a wave guiding structure so that at successive points along the structure each time a fraction of the wave energy is radiated to the far field. As a result the wave energy gradually decreases along the structure. The travelling wave defines predetermined phase relationships between the radiations from different points along the structure and thereby a direction (if any) in which the radiation from the points leads to coherently radiation, so that the structure acts as an antenna. Usually, leaky wave antennas have a limited bandwidth, which is defined by the characteristic dimensions of the wave guiding structure.

In a co-pending patent application by the same inventor and assigned to the same assignee an antenna is described with a conical dielectric body on a conductive ground plane that contains a non-conductive antenna slot. This application is incorporated herein by way of reference. The dielectric body has truncated elliptical cross-sections, so that the antenna slot runs along a line through foci of each elliptical cross-section. This antenna, per se, supports extremely broadband radiation, but its bandwidth is limited by the feed structure that is needed to couple radiation into and/or out of the antenna slot.

SUMMARY OF THE INVENTION

Among others, it is an object of the invention to provide for an ultra wideband antenna, wherein a feed structure need not limit the antenna bandwidth.

A leaky wave antenna according to the invention is set forth in claim 1. The antenna comprises a first and a second leaky wave antenna structure with wave carrying structures and dielectric bodies that adjoin in a common plane between the two structures ("adjoin" as used here covers both a meeting of separate bodies and a body that continues from the body of the one antenna structure into the other, so that the common plane is merely a virtual plane through the continuous body). The common plane forms respective angles to the wave carrying structures in the two leaky wave antenna structures that equal the angles at which leaky waves are radiated from the wave carrying structures into the dielectric bodies. As a result an angle between the respective wave carrying structures equals a sum of said angles, The feed of the antenna excites waves in both antenna structures together. Thus the antenna structures mutually form loads for each other, avoiding use of a feed structure that involves critical dimensions that limit antenna bandwidth.

Typically, the wave carrying structures are realized using conductive ground planes comprising respective non-conductive slots. In this case the angle between the ground planes is the sum of said angles of propagation of the leaky waves. Alternatively comprise conductive tracks may be used which are at an angle that is the sum of said angles.

Preferably the feed is arranged to excite the waves substantially from the common plane between the two antenna structures. This minimizes bandwidth limitation and improves the antenna pattern. Preferably the leaky wave antenna structures are substantially mutually mirror symmetric with respect to the common plane. This improves the antenna pattern.

In an embodiment the bodies of the leaky wave antenna structures are each at least partly conically shaped, having a series of cross-sections of truncated elliptical shape, wherein each shape is truncated substantially through a first focus of the elliptical shape along a truncation line that extends substantially perpendicularly to a main axis of the elliptical shape, a second focus of the elliptical shape lying within the body; the wave carrying structures extending substantially along a focal line through the first foci of the elliptical shapes in successive cross-sections. This type of leaky wave antenna structure supports use of frequencies from a very wide frequency band. By combining two of such structures with a single feed this broadband characteristic can be preserved by the feed. However, it should be realized that the bandwidth limiting effect of the feed can also be avoided in other types of antenna, for example by using a dielectric body of a different shape with an added coating at its surface to minimize reflections at the surface where the leaky wave leaves the dielectric body.

In a further embodiment a size of the cross-sections in each leaky wave antenna structure tapers so that a virtual top line is perpendicular to a direction of coherent propagation of the leaky wave from the elongated wave carrying structure into the dielectric body (the top line runs through crossing points of the perimeters of the elliptical shapes and the main axes of the ellipses that are furthest from the first focus). Hence, the angle between the virtual top line and the wave carrying structure equals ninety degrees minus the angle of propagation of the leaky wave from the wave carrying structure. Preferably, the virtual top lines of the two leaky wave antenna structures together form a single straight line. This increases the broadband behaviour and makes it easier to manufacture the antenna.

Because of its broadband behaviour the antenna can be used with transmission and/or reception equipment that is operative to receive and/or transmit signals with mutually different frequencies that are far apart, for example at least a factor of two apart, but operation with frequencies over a wider band are feasible. Even frequencies that are a factor ten apart are possible, for example over a band from 4 to 40 Gigahertz.

BRIEF DESCRIPTION OF THE DRAWINGS

These and other objects and advantageous aspects of the invention will be described by non-limitative examples using the following figures.

DETAILED DESCRIPTION OF THE DRAWINGS

Figure 1:
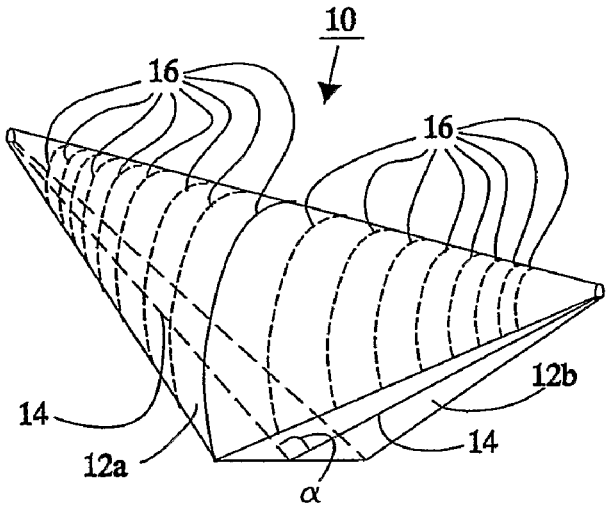
FIG. 1 shows an antenna structure.

FIG. 1 shows an antenna structure. The antenna structure comprises a dielectric body 10, which is shown schematically by a number of cross-sections 16. A first conductive ground plane 12*a* and second conductive ground plane 12*b* are attached to the dielectric body 10 at an angle α (alpha) with respect to each other. Narrow non-conductive antenna slot 14 run along the length of the antenna structure in the ground planes 12*a,b*.

Dielectric body 10 is made up of two halves of conical shape, each with cross-sections 16 that have the shape of truncated ellipses. The truncations of the cross-sections in a half rest on the ground plane 12*a,b* that is attached to that half. Each halve is broadest in the plane where it meets the other half and the widths of the cross-sections taper away from that plane.

In operation waves of electromagnetic radiation travel from the junction between the ground planes 12*a,b* along the antenna slots 14. The speed of propagation is such that a leaky wave is radiated from the antenna slots 14 through the dielectric body 10 at an angle ϕ (phi) with respect to the antenna slots 14. The angle α (alpha) between the ground planes 12*a,b* has been selected so that the central directions of radiation (in a plane perpendicular to the ground planes 12*a,b*) in both halves of the antenna structure run in parallel with one another. That is, so that alpha=2*phi. In this way radiation from both halves contributes to the same antenna lobe.

Figure 2:
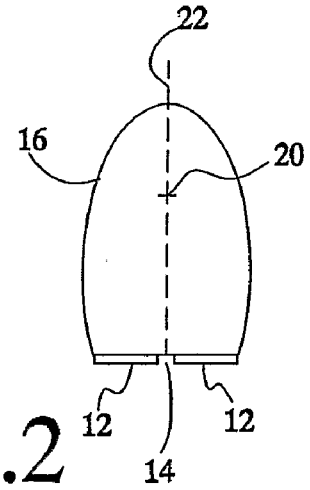
FIG. 2 shows a cross-section of an antenna structure.

FIG. 2 illustrates one cross-section 16 of the dielectric body, showing its truncated elliptical shape, a cross-section of ground plane 12 (12*a* or 12*b*, with exaggerated thickness) and a cross-section of antenna slot 14 (with exaggerated width). A virtual line 22 shows the main axis of the ellipse (the axis through its focal points; as is well known the two focal points of the ellipse are defined by the fact that the sum of the distances from any point on the perimeter of the ellipse to both focal points is independent of the point on the perimeter). Antenna slot 14 runs substantially through a first one of the foci (focal points) of the ellipse and extends transverse to the plane of the drawing through foci of the elliptical shapes of other cross-section. The second focus (focal point) 20 of the ellipse lies within dielectric body. The ellipse is truncated along a line that runs perpendicular to the main axis of the ellipse and substantially through the first focus of the ellipse. Ground plane 12 extends transverse to the elliptical cross-sections 16.

Figure 3:
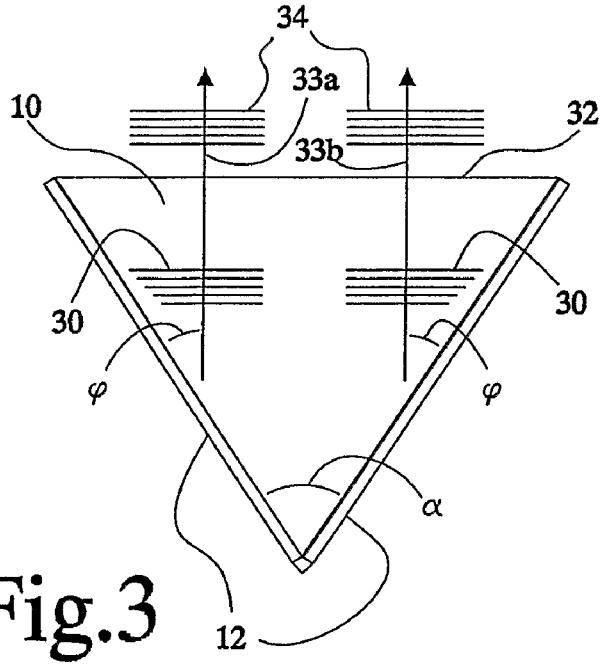
FIG. 3 shows another cross section of an antenna structure.

FIG. 3 shows another cross-section of the dielectric body 10, in this case through a plane that runs through the main axes 22 of the ellipses and the antenna slots 14 (not shown). Dielectric body may be made for example of TMM03 material, on sale in the form of slabs from Rogers. This material has a dielectric constant of 3.27. Of course other materials may be used, for example with a relative dielectric constant between 1.5 and 4. In the case that slab shaped material is used, the slabs may be stacked and shaped to realize the electric body. The lowest slab may be provided with an attached copper ground plane with a thickness of approximately 0.1 millimeter in which antenna slot 14 may be milled, with a width of say 0.2 millimeter. However, it should be realized that these dimensions and this way of manufacturing are merely given by way of example. The width should preferably be less than a quarter of the wavelength in the dielectric material. The width of 0.2 millimeter may be used for frequencies in the range of 10-30 Gigahertz. Higher frequencies, even in the Terahertz range are possible, but in that case a different manufacturing will be used to realize a correspondingly narrower slot. Other dimensions and manufacturing techniques may be used.

Operation of the antenna is based on the fact that the propagation speed of waves along a slot 14 in a conductive ground plane 12 is substantially independent of the wavelength of the wave, if ground plane 12 is bounded by two infinite half-spaces of mutually different dielectric constant, provided that the slot width is substantially smaller than the wavelength (smaller than a quarter of the wavelength). This means that such a slot will act as a leaky wave antenna, which radiates into one of the half-spaces in a direction that is independent of the wavelength of the radiation.

In practice infinite half spaces of dielectric material are of course impossible. This means that finite bodies of material must be used, but normally the finite size of the body affects the speed of propagation of the waves along antenna slot 14 in a wavelength dependent way. This wavelength dependence limits the antenna bandwidth, and makes the direction of radiation wavelength dependent.

In the present antenna, the wavelength dependence is minimized by the use of a dielectric body 10 with truncated elliptical cross-sections with one focus at the position of the antenna slot 14. Preferably, cross-sections through plane parallel to the direction of propagation of the leaky wave through the dielectric have this shape and have their first focus at the antenna slot 14. As will be appreciated this direction depends on the speed of wave propagation along antenna slot 14, which in turn depends on the dielectric constants of the dielectric material of body 10 and the surrounding space. The required direction can be determined theoretically, by means of simulation or by means of analytical solutions, or experimentally, by observing the direction of propagation in the dielectric body.

The half-space below each ground plane 12 is formed by air (or a vacuum, or by some other gas or fluid). The upper half-space is approximated by the dielectric body 10. Because of the elliptical cross-sections radiation from the antenna slot 14 can only react back on the antenna slot 14 after two reflections on the perimeter of the dielectric body 10. This minimizes the effect of the finite size of dielectric body 10, with the result that the wavelength independent propagation speed for an infinite half space is closely approximated for waves that propagate along the slots in each of the ground planes. Preferably, the elliptical cross-sections are shaped so that their eccentricity substantially equals the square root of the relative dielectric constant of the dielectric body 10 with respect to that of the surrounding space.

The result is that radiation leaks from antenna slot 14, giving rise to wavefronts 30 that travel in a direction 33*a,b* at an angle ϕ to ground plane 12, the angle ϕ being determined by the speed of propagation along antenna slot 14, which is a function of the dielectric constant of the dielectric body but is substantially independent of the wavelength. Due to the selection of the angle α (alpha) between the ground planes 12 the directions 33*a,b* of propagation of the leaky waves in the two halves are parallel to each other. In the case of the example where the dielectric constant is 3.27 the angle ϕ equals approximately forty degrees.

In the embodiment of the figures the size of the elliptical cross-sections tapers towards the end of the antenna structure in both halves so that, at least on the main axes 22 of the ellipses, the wave-fronts 30 of equal phase in both halves run parallel to the top line surface 32 of the body at the top of the ellipse (where the main axes 22 cross the surface of the ellipse) toward which the wave-fronts 30 travel. As a result, the wave has normal incidence on surface 32 and proceeds with wave fronts in the same direction 33*a,b* after leaving the dielectric body. This arrangement with a tapering so that surface 32 is substantially perpendicular to the direction of propagation of the radiated wave is preferred to minimize reflections.

However, without deviating from the invention top line surface 32 may comprise sub-surfaces at a mutual angle symmetrically on either side of the plane of symmetry of the antenna, i.e. at equal angle with respect to the wave fronts 30. As long as the angle is kept so small that no total reflection occurs this merely results in breaking of the direction of radiation when the radiation leaves dielectric body 10, with some increased loss due to reflections.

As shown, ground plane 12 extends substantially over the full width of the truncations, but no further. This is convenient for mechanical purposes, but not essential for radiative purposes: without deviating from the invention the ground plane may extend beyond the elliptical cross-sections or cover only part of the truncation. Preferably the width of the ground plane 12 away from the slot is so selected large that it contains the area wherein the majority of the electric current flows according to the theoretical solution in the case of an infinite ground plane, for example so that the ground plane 12 extends over at least one wavelength on either side of the slot 14 and preferably over at least three to four wavelengths.

A conductive track may be used instead of non-conductive antenna slot 14 that is shown in the figures, when the conductive ground plane 12 is omitted or replaced by a non-conductive ground plane. Like the antenna slot 14, such a conductive track that extends through one of the foci of successive cross-sections gives rise to substantially wavelength independent propagation speed and leaky wave radiation that provides an antenna effect.

Typically a single non-conductive slot or conductive track extends through the focal line. In the case of the slot this leads to a propagating field structure with electric field lines from one half of the ground plane to the other and magnetic field lines through the slot, transverse to the ground plane. Preferably no additional slot is provided in parallel with the slot. However, a similar propagating field may be realized with one or more additional slots in parallel to the slot, provided that these slots are excited in phase with the excitation of the slot, or at least not excited completely in phase opposition to the excitation of the slot. Out of phase (but not opposite phase) excitation of different slots may be used to redirect the antenna beam.

Similar considerations hold for the conductive track, except that the role of magnetic and electric fields is interchanged. Preferably a single conductive track is used, but more than one track may be used, provided that the tracks are preferably not excited in mutual phase opposition.

Although the invention is illustrated for the case of transmission of radiation, it will be realized that, owing to the principle of reciprocity, the antenna also operates to receive radiation from the direction in which it can be made to radiate, i.e. from a substantially wavelength independent direction.

Figure 4:
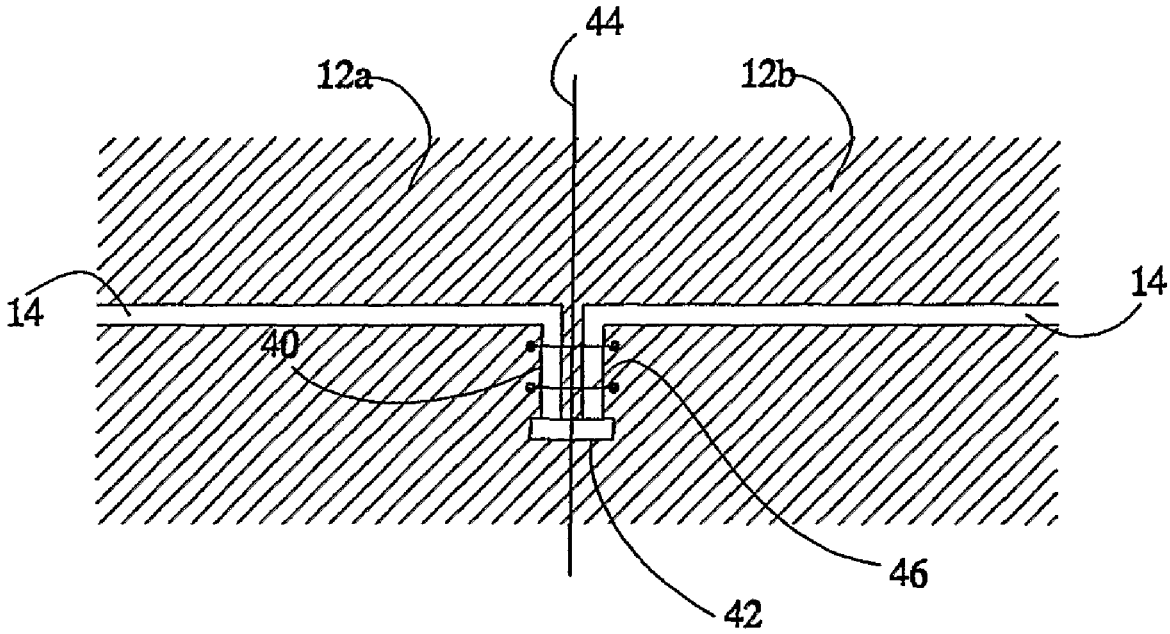
FIG. 4 shows a feed structure.

FIG. 4 shows an example of a feed structure of the antenna. Preferably the feed structure is integrated at the juncture of ground planes 12*a,b*. The feed structure of FIG. 4 is one embodiment; comprising two mutually parallel feed slots 40 on either side of a tongue of conductive material transverse to antenna slot 14. Feed slots 40 form a wave-guide that ends in a short-circuit at antenna slot 14. Preferably the feed structure is located at the junction of the two halves of the antenna (indicated by line 44), where the two ground planes 12 meet at the angle alpha.

The feed structure makes use of magnetic field excitation, which excites a wave in antenna slot 14 on either side of the feed structure by means of a magnetic field in the antenna slots 14 with field lines substantially perpendicular to ground planes 12. Such a magnetic field can be induced with a conductor that crosses the antenna slot, such as the tongue between feed slots 40.

Because the wave-guide ends in a short-circuit at antenna slot 14, a current maximum is created (and therefore a magnetic field maximum) at the position of antenna slot 14. Thus maximum excitation of waves in antenna slots 14 is realized. These waves travel along the length of the antenna slots 14 in both directions from the feed structure.

It should be understood that the invention is not limited to this particular feed structure. Other feed structures may be used, for example a feed structure that is not integrated in the ground planes 12*a,b*, or that is integrated in a different way. Preferably such a feed structure should be arranged to excite a magnetic field in the slot 14 with a field direction transverse to the ground planes 12*a,b* Preferably such a field is excited at the junction of the ground planes 12*a,b*. However in other embodiments the field may be excited at a point or region in one of the ground planes, so that a wave travels from this point or region to the junction and beyond, as well in the opposite direction from the point or region to the tip of the antenna.

Figure 5:
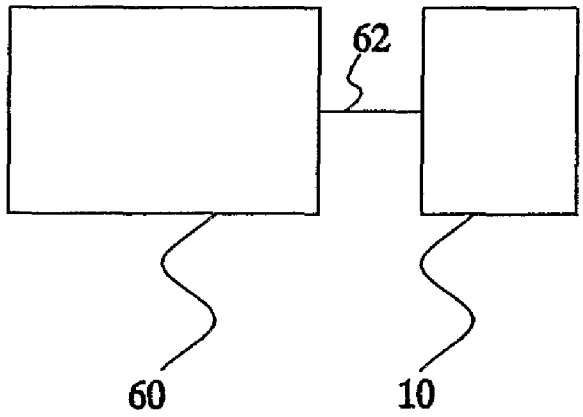
FIG. 5 shows a transmission and/or reception system.

FIG. 5 shows a transmission and/or reception system comprising a transmitter and/or receiver 60 with a connection connected to the antenna structure. The system is arranged to supply and/or receive fields over a wide range of frequencies. In an example the system is arranged to support frequencies that are a factor two apart, but larger ranges of up to a factor ten are contemplated. Transmitter and/or receiver 60 may comprise separate apparatuses for these different frequency bands, but a combined apparatus may be used alternatively.

It should be appreciated that the actual antenna structure with antenna slot 14 is suitable for an extremely broad band of frequencies. Although a simple feed structure has been described, it should be appreciated that different feed structures are possible. When a conductor track is used instead of antenna slot 14, feed structures may be used that are the dual of the feed structure for antenna slot, i.e. wherein conductive parts are replaced by non-conductive parts and vice versa.

By now it will be appreciated that an extremely broadband antenna structure is realized by means of an antenna structure with a dielectric body of truncated elliptical cross-section, with a ground plane with a slot that extends through the foci of the elliptical cross-sections or a conductor that extends through the foci. By using a structure that is made up of two halves bandwidth limitations due to the feed structure can be avoided. Preferably, halves that mirror symmetric copies of each other are used, that halves adjoining each other in a plane that forms angles $\phi$ with the ground planes 12 in the respective halves ($\phi$ being the angle at which the leaky waves radiate from the ground plane). Preferably the field is excited in (or received from) the slot substantially at the plane of symmetry between the two halves. Thus a symmetric excitation with a signal leaky wave radiation lobe can be realized.

It should be appreciated that other configurations are possible. In other embodiments the two halves of the antenna need not be mirror symmetric copies of each other. In fact the two halves need not even have the same dielectric constant. For example, if material with different dielectric constants are used in the two halves on either side of the central plane respectively, a structure that is symmetric for the purpose of the radiative properties may be realized by designing the two halves each according to the angle $\phi$ and $\phi'$ of leaky wave radiation that corresponds to the dielectric constants in the two halves.

Non-symmetric structures may be used as well, for example if two antenna lobes need to be provided, so that each halve has its own particular shape to realize a part of the antenna pattern. In fact, although the truncated elliptical shape is preferred, embodiments are possible wherein other shapes are used. In this case too, a double structure may be used with a slot or track that runs on to support emission of the leaky wave in both parts of the structure, the slot or track being use to excite waves in both parts of the structure together, preferably at the junction of the parts. For example a dielectric body of a non-elliptic shape may be used with an added coating at its surface to minimize reflections at the surface where the leaky wave leaves the dielectric body.

Transmitter and/or receiver equipment 60 may be attached to the antenna structure to supply and/or receive fields of widely different frequency simultaneously and/or successively to the antenna structure for effective transmission and/or reception. Various feed structures may be used to excite or receive waves from the antenna slot. In an embodiment the feed structures may be integrated in the ground plane. Typically, the feed structures are selected dependent on the frequency or frequencies at which the transmitter and/or receiver equipment 60 uses the antenna structures.

The invention claimed is:

1. A leaky wave antenna, comprising:

a first leaky wave antenna structure and a second leaky wave antenna structure, each, comprising:

a dielectric body and an elongated wave carrying structure, the dielectric body and elongated wave carrying structure in each of the first and second leaky wave antenna structures being mutually arranged to radiate a leaky wave from the elongated wave carrying structure through the dielectric body, the leaky wave in each respective leaky wave antenna structure radiating at a respective angle to the elongated wave carrying structure, and wherein the dielectric body of the first leaky wave antenna structure and the dielectric body of the second leaky wave antenna structure adjoin each other in a common plane that is at the respective angles to the wave carrying structures of the first and second wave antenna structure respectively, the respective wave carrying structures meeting each other at said common plane, and wherein the antenna comprises a feed arranged to excite waves in both the respective wave carrying structures together.

2. A leaky wave antenna according to claim 1, wherein the feed is arranged to excite the waves substantially in said common plane.

3. A leaky wave antenna according to claim 1, wherein the first leaky wave antenna structure and the second leaky wave antenna structure are substantially mirror images of each other with respect to the common plane.

4. A leaky wave antenna according to claim 1, wherein the dielectric bodies of the first and second leaky wave antenna structures each are at least partly conically shaped, and have a series of cross-sections of truncated elliptical shape, wherein each cross-section of truncated elliptical shape is truncated substantially through a first focus of an elliptical shape along a truncation line that extends substantially perpendicularly to a main axis of the elliptical shape, a second focus of the elliptical shape lying within the body; and the elongated wave carrying structure extending substantially along a focal line through the first focus of the truncated elliptical shapes in successive cross-sections.

5. An antenna according to claim 4, wherein main elliptical axes of each of the truncated elliptical shapes substantially coincide with a direction of coherent propagation of a leaky wave from the elongated wave carrying structure into the dielectric material.

6. An antenna according to claim 4, wherein a size of the series of cross-sections in each leaky wave antenna structure tapers so that a virtual top line of the body is perpendicular to a direction of coherent propagation of the leaky wave from the elongated wave carrying structure into the dielectric body, the virtual top line running through points on the perimeters of the body where the main axes of the ellipses intersect the perimeter.

7. An antenna according to claim 6, wherein the virtual top lines of the series of cross-sections in each leaky wave antenna structure together form a single straight line.

8. An antenna according to claim 1, further comprising conductive ground planes adjoining surfaces of the each dielectric body of the respective first and second leaky wave antenna structures, the elongated wave carrying structures comprising respective slots in the respective dielectric bodies, a further angle between the conductive ground planes equaling a sum of said angles at which the leaky waves are radiated.

9. An antenna according to claim 1, wherein the wave carrying structures comprise conductive tracks at a further angle with respect to one another, the further angle equaling a sum of said angles with respect to each other.

10. A transmission and/or reception apparatus, comprising:

an antenna comprising:

a first leaky wave antenna structure and a second leaky wave antenna structure, each, comprising:

a dielectric body and an elongated wave carrying structure, the dielectric body and elongated wave carrying structure in each of the first and second leaky wave antenna structures being mutually arranged to radiate a leaky wave from the elongated wave carrying structure through the dielectric body, the leaky wave in each respective leaky wave antenna structure radiating at a respective angle to the elongated wave carrying structure, and wherein the dielectric body of the first leaky wave antenna structure and the dielectric body of the second leaky wave antenna structure adjoin each other in a common plane that is at the respective angles to the wave carrying structures of the first and second wave antenna structure respectively, the respective wave carrying structures meeting each other at said common plane, and wherein the antenna comprises a feed arranged to excite waves in both the respective wave carrying structures together; and a signal processing apparatus that is operative to receive signals from the feed and/or supply signals for transmission to the feed, the apparatus being arranged successively and/or simultaneously to supply and/or receive the signals with mutually different frequencies that are at least a factor of two apart.

11. A transmission and/or reception apparatus according to claim 10 wherein the mutually different frequencies are at least a factor of ten apart.

* * * * *

UNITED STATES PATENT AND TRADEMARK OFFICE

CERTIFICATE OF CORRECTION

PATENT NO. : 7,916,094 B2
APPLICATION NO. : 11/572480
DATED : March 29, 2011
INVENTOR(S) : Andrea Neto, Raymond van Dijk and Filippo Marliani It is certified that error appears in the above-identified patent and that said Letters Patent is hereby corrected as shown below:

Column 8, line 24, change “dielectric bodies” to read -- ground planes --.

Signed and Sealed this
Thirty-first Day of May, 2011

David J. Kappos

David J. Kappos
*Director of the United States Patent and Trademark Office*